United States Patent [19]

Middleton et al.

[11] 4,033,494

[45] July 5, 1977

[54] STAMP DISPENSING MECHANISM

[75] Inventors: Charles G. Middleton, Arlington Heights; Vincent F. Volpe, Niles, both of Ill.

[73] Assignee: Gard, Inc., Niles, Ill.

[22] Filed: June 17, 1976

[21] Appl. No.: 697,025

[52] U.S. Cl. ..... 226/83; 74/436; 226/6; 226/11; 226/89; 226/134; 226/156

[51] Int. Cl.[2] ..... B65H 17/22

[58] Field of Search ..... 226/6, 11, 38, 82, 83, 226/90, 134, 135, 136, 152, 156, 188, 89; 74/436

[56] References Cited

UNITED STATES PATENTS

| | | | |
|---|---|---|---|
| 2,704,395 | 3/1955 | Heidegger | 74/436 X |
| 3,255,941 | 6/1966 | Edwards | 226/83 X |
| 3,655,109 | 4/1972 | Stevens | 226/135 X |

*Primary Examiner*—Richard A. Schacher
*Attorney, Agent, or Firm*—Claron N. White

[57] ABSTRACT

A stamp dispensing mechanism has a cylindrical feed wheel, with axially-parallel rows of projections, rotatably mounted on a front portion of a vertical support plate that is constructed to rotatably support a roll of stamps on its rear portion. A Geneva star wheel, rotatably mounted on the plate, is operatively connected to the feed wheel for its step movement with the star wheel. A Geneva driver assembly, rotatably mounted on the plate, has a driver pin on an arm rotated by a motor also mounted on the plate. During one rotation of the arm, the pin moves into and out of a slot of the star wheel for its step movement. An arcuate part of the arm is in a recess in the periphery of a tooth of the star wheel, when the pin is not in the slot, to lock that wheel. The rear portion of the top and bottom walls of a horizontal opening of an enclosure, mounted on the plate forwardly of the feed wheel, provides a rearwardly facing surface, with arcuate grooves, in which the forward chordal section of the feed wheel extends with its projections in the grooves. An arcuate guide with arcuate grooves is pivotally mounted at one end on the plate and lockable at the other end to overlie the feed wheel with its projections in those grooves.

14 Claims, 14 Drawing Figures

FIG. 7
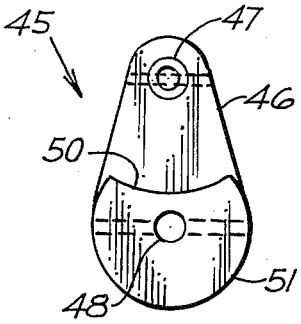
FIG. 14
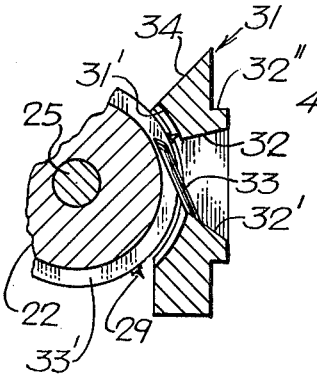
FIG. 8
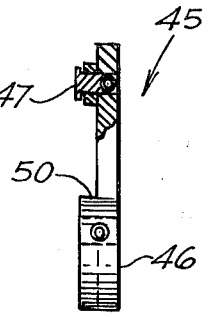
FIG. 9
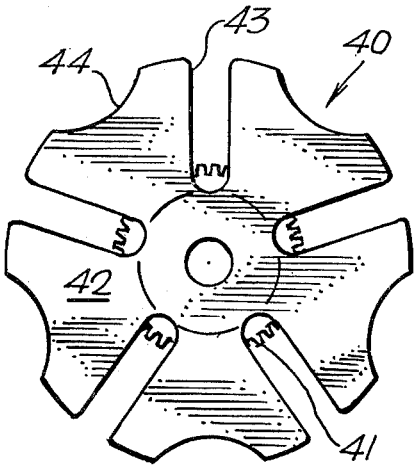
FIG. 10
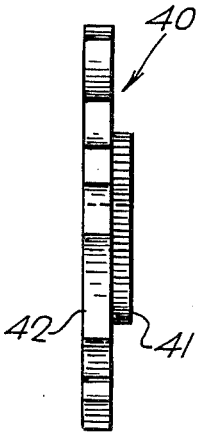
FIG. 11
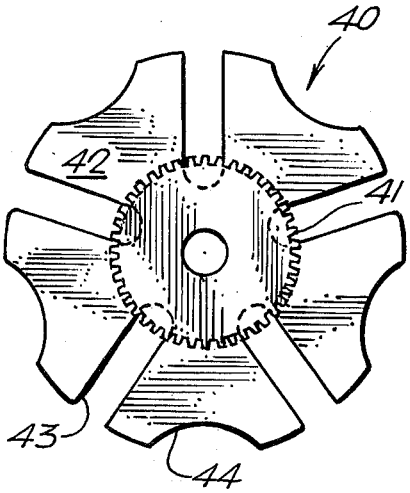
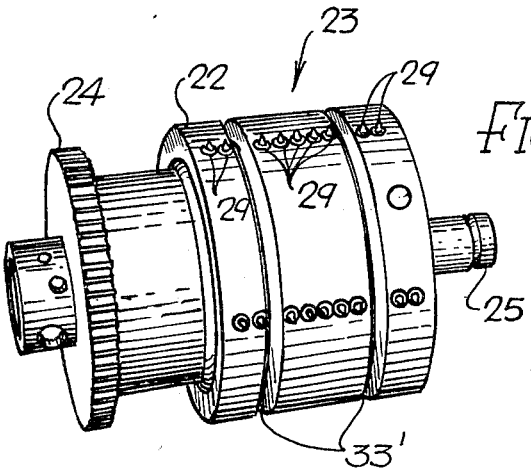
FIG. 12
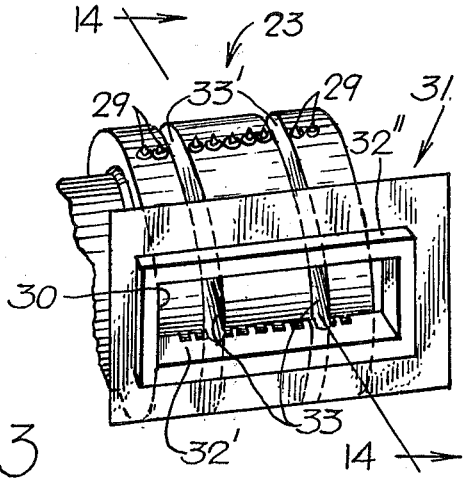
FIG. 13

STAMP DISPENSING MECHANISM

CROSS-REFERENCE TO RELATED APPLICATION

This invention is useful in the construction of stamp dispensing modules for a stamp vending machine, that is described and claimed in a patent application Ser. No. 697,024, filed June 17, 1976, by Walter A. Peters, Curtis A. Hozian and Richard W. Gusek and entitled, "Stamp Vending Machine". That application and the present application are assigned to a common assignee.

BACKGROUND OF THE INVENTION

1. Field of the Invention

The invention relates to a mechanism for dispensing one or more stamps or the like from a strip and relates to the Geneva drive system of the stamp dispensing mechanism of the invention.

2. Description of the Prior Art

A number of U.S. Patents have been granted for stamp vending machines that have more than one stamp dispensing mechanism, i.e., module. Illustrative patents are U.S. Pat. Nos. 3,548,991 and 3,655,109. Each machine of these patents is constructed to dispense various combinations of stamps of various denominations from modules of the machine that include for each module a magazine containing a roll of a strip of stamps. Each module is operated to feed, for one cycle of operation, a length of a strip through an associated opening in the front panel of the machine. The length of the strip fed through the opening is dependent upon the number of stamps to be dispensed from the module. The number of stamps, as a strip, that pass through the opening, is dependent upon the coins or coin, respectively, introduced in the slot in the front panel and, in the case of the machine of U.S. Pat. No. 3,548,991, is dependent upon the button that is pressed to select a particular combination of stamps. When sufficient change has been fed through the slot of the machine of U.S. Pat. No. 3,548,991 and a button corresponding to the change is pressed, the cycle of operation of each module required for the dispensing of the particular combination of stamps is initiated.

For each module having its operation initiated, its motor will turn a feed wheel or a drive roller for a predetermined number of steps of partial rotation to feed through the associated opening a length of the strip that is subsequently cut or manually torn from the balance of the strip that remains inside the machine. At the completion of the operation of a module of the machine, the module of each patent is constructed to prevent the strip from being manually pulled through the opening to obtain more stamps that was fed through the opening in the machine during the programmed operation of the module.

The module used in the machine of U.S. Pat. No. 3,548,991 is an improvement over the single stamp dispensing module used in the machine of U.S. Pat. No. 3,538,801. In that earlier module a pulse, provided by pressing a select button, to a solenoid initiates the operation of the module to present externally of the module a number of connected stamps that this module can feed during one cycle of its operation. This operation of the solenoid by the initiating pulse raises a pawl from a counting roller. The raised pawl closes a switch that energizes a driving motor that then turns a drive roller. At the time that the motor is energized, the closed switch energizes a solenoid to move a cutter from the opening through which the strip of stamps passes. The counting wheel is rotated by a moving strip over which it passes before passing between the drive roller and a pinch roller.

The counting roller or wheel has rows of projections that are spaced so that they mate with perforations between adjacent stamps of the strip of stamps and thereby the counting roller is turned to count, as the strip is pulled between the drive roller and the pinch roller. The counting roller has also a plurality of notches about its periphery and the pawl of a pawl assembly, when raised, is moved out of one of these notches. The construction of the pawl assembly is such that the pawl moves into the next notch during the turning of the counting roller. When this happens, the switch opens whereby the driving motor is de-energized and the solenoid for the cutter is de-energized. The cutter operates to cut the strip of stamps at the opening of the dispensing module. This cut is at a row of perforations of the strip.

The opening of the switch stops the drive of the strip of stamps because it stops the rotation of the driving roller. The number of stamps that is dispensed through the opening is determined by the equal spacing between the notches of the counting roller. To change the number of stamps dispensed by the module for a cycle of operation, it is necessary to replace the counting roller with a counting roller having different equally spaced notches. With this construction of the module of a stamp vending machine, it it is not possible for a particular stamp denomination to use the machine to dispense different numbers of stamps merely by pressing different buttons.

U.S. Pat. No. 3,548,991 discloses a dispensing module that is basically the same as that disclosed in U.S. Pat. No. 3,538,801. It has a latch arm, that is raised by the operation of a latch solenoid by a pulse, that is provided by operating a select switch. The latch arm is raised, by the operation of the latch solenoid, from the one of the equally spaced notches in the counting roller or wheel, that has the equally spaced rows of projections. This movement of the latch arm closes a latch arm switch to start the operation of the driving motor. The counting roller is driven by the motor. The motor is also coupled to a countdown gear. Selector solenoids are mounted on the frame of the module and engage latch triggers that control a trip cone for de-energizing a countdown switch. The selector solenoids are counting solenoids and they select the number of stamps which will be dispensed for a particular operation of the module.

The operation to dispense a number of stamps is determined by which of the counting solenoids is energized. The latch solenoid maintains the latch arm out of contact with the counting roller until the countdown gear has been turned by the motor to the position that the energized counting solenoid is effective to de-energize the latch solenoid that raised the latch arm. The arm lowers to engage a notch in the counting roller and the latch switch is de-energized so that the motor stops. Then the counting wheel is locked by the lowered latch arm so that the strip of nondispensed stamps cannot be pulled out of the module.

U.S. Pat. No. 3,655,109 discloses a stamp dispensing machine having a number of stamp dispensing modules. Each of the modules includes a feed wheel that has a substantially cylindrical outer surface except for a plurality of recesses that are substantially rectangular in shape. The recesses are equidistantly spaced by the circumference of the feed wheel. Each of these cylindrical surface portions between the recesses contains a row of projections. The recesses are located so that adjacent rows of projections from the cylindrical surface are spaced at a distance to the longitudinal distance between rows of perforations in the strip of stamps.

The feed wheel is driven in a stepwise fashion by a motor through a Geneva cam mechanism that includes a Geneva cam wheel. A gear carries a drive pin along a circular path. During approximately one-half of this path the pin is in engagement with teeth of the Geneva cam wheel. One rotation of the gear carrying the pin provides one step of the rotation of the Geneva cam wheel. The gear carrying the drive pin is driven by the motor through a gear train. One of the gears of the gear train has an arcuate camming recess that has inwardly sloping end walls. A Geneva switch assembly that includes a cam follower pin that has its end held in engagement with the surface of the gear having the recess. The engagement is at a point of the circumferential track of the recess. A pair of switch contacts are mounted with one of the switch contacts being resiliently held in engagement with the other end of the cam follower pin. When the cam gear containing the arcuate recess is rotated, the cam follower pin is moved into and out of a cam recess so that the Geneva switch contacts are alternately opened and closed. These switch contacts are connected in a series circuit with a coil of a solenoid so that the solenoid coil is energized when the switch contacts are closed and de-energized when the switch contacts are opened. The alternate energization and de-energization of the solenoid steps a rotational stepping apparatus. Simultaneously with each step of the stepping switch apparatus a count of one unit is registered by a counter. Thus, the motor, when operating to drive the feed wheel in a stepwise fashion through the Geneva cam mechanism, also intermittently operates the stepping switch and the counter. A control circuit cooperates with the stepping switch to stop the machine when a predetermined number of stamps have been dispensed. A lock is moved into one of the recesses of the feed wheel either after each intermittent operation of the feed wheel or after each dispensing cycle of operation. This movement of the lock into a recess is initiated by the control circuit described above. This lock is necessary, because the Geneva cam assembly does not prevent the rotation of the feed wheel by pulling on the undispensed strip of stamps when the motor is shut off.

SUMMARY OF THE INVENTION

One stamp dispensing mechanism of the present invention is used in a machine that dispenses only stamps from one roll of a strip of stamps. A number of stamp dispensing mechanisms of the invention are used as modules of a stamp dispensing machine that provides stamps from a number of rolls of strips of stamps.

The stamp dispensing mechanism comprises: a vertical support plate; motor means mounted on the support plate; a novel Geneva driver assembly mounted on the support plate for rotation about a horizontal axis and including it an integral construction a tapered arm and a Geneva driver pin mounted on the arm; gear means mounted on the support plate and engaging the motor means to rotate the arm for a movement of the driver pin about the axis of rotation of the arm during operation of the motor means; a novel Geneva star wheel mounted on the support plate for rotation about a horizontal axis; a feed wheel mounted on the support plate for rotation about a horizontal axis; means operatably connecting said feed wheel to the star wheel for step turning of the feed wheel during step turning of the star wheel; and a horizontal shaft mounted on the vertical support plate for rotatably mounting a roll of a strip having equidistantly spaced-apart rows of perforations and providing a connected series of units, such as stamps. Preferably, the star wheel is integral with a coaxial gear as a Geneva star wheel assembly and the feed wheel is integral with a coaxial gear as a strip-feeding assembly. In that construction these two gears provide the means to step turn the feed wheel during step turning of the star wheel. The description that follows assumes that this construction is present.

The feed wheel has a generally cylindrical construction with rows of projections extending outwardly from the cylindrical surface, each row being parallel to the longitudinal axis of the wheel and the distance between rows being equal to the longitudinal distance between rows of perforations of the strip of the magazine. The Geneva star wheel has equally spaced radial slots to provide lobes, i.e., teeth, each with a peripheral outer surface that is cylindrical except for an intermediate major portion that is a concave surface having a predetermined radius of curvature. The tapered arm of the Geneva driver assembly has a hole through its wider portion for fixedly mounting the arm on the output shaft of the gear means that is operated by the motor means. The Geneva driver pin is mounted on the narrower portion adjacent its distal end to extend, parallel to the hole, from a major surface of the arm. The arm is constructed so that part of the thickness of its wider portion is between parallel planes passing through and normal to the driver pin and this part has a cylindrical peripheral surface, that extends at its ends toward the shoulder provided by this part of the wider portion at the junction of the wider portion with the narrower portion of the arm. That cylindrical peripheral surface has its center of curvature at the center of the hole in the arm to be spaced from but move out of one cavity provided by the concave peripheral surface of the intermediate major portion of a tooth during the angular step movement of the star wheel provided by the driver pin during a part of one rotation of the arm of the driver assembly and before its complete rotation moves a part of that cylindrical surface of the wider portion of the arm within the next cavity of the stepped star wheel to prevent rotary movement of the Geneva star wheel assembly when a unit, e.g., stamp, is not being dispensed. The shoulder facing the pin is shaped and located between the pin and the axis of rotation of the arm so that this shoulder will clear, i.e., be spaced from, a cylindrical peripheral portion of adjacent teeth during each step movement of the wheel of the Geneva star wheel assembly.

The gear ratio of the gear of the feed wheel assembly and the gear of the Geneva star wheel assembly is such that each step movement of the feed wheel provided by each step movement of the Geneva star wheel assembly moves the strip a distance equal to the distance between the rows of perforations of the strip of stamps. The spacing of the radial slots of the Geneva star wheel is such that this step movement of the star wheel assembly will be provided by the pin of the Geneva driver assembly moving into and then out of one radial slot of the Geneva star wheel, during one revolution of the Geneva driver assembly.

The length of the radius of curvature of the cylindrical peripheral surface of the wider portion of the arm of the Geneva driver assembly and the location of the driver pin are such that, during the rotation of the Geneva driver assembly, the pin will move into and out of a radial slot of the Geneva star wheel to step the wheel and the cylindrical peripheral surface will be in the cavity of a tooth of the Geneva star wheel at the completion of each revolution of the arm. The wider portion of the arm has its shoulder, that faces the driver pin, located sufficiently close to the axis of rotation of the arm that it is spaced from a tooth of the star wheel being stepped during a rotation of the arm of the Geneva driver assembly.

The stamp dispensing mechanism of the invention includes means to retain the strip of stamps in engagement with rows of projections during its travel by the feed wheel in an arcuate path and to direct the strip of stamps away from the feed wheel at the completion of the arcuate travel. This strip-retaining means comprises an arcuate guide that is pivotally mounted on the support plate rearwardly of the feed wheel, and an enclosure fixedly mounted on the support plate partially forwardly of the feed wheel and partially surrounding a fowardly-facing chordal segment of the feed wheel.

The central portion of the rearwardly-facing surface of the enclosure has a rectangular recess having a cylindrical surface. A forwardly flared rectangular opening extends from the base portion of this cylindrically-shaped recess to the central portion of front face of the enclosure and this opening has diverging top and bottom walls from the recess to the front surface of the enclosure. Two fingers extend upwardly and rearwardly from the bottom wall of the diverging walls of this opening and into and spaced from two spaced annular grooves of the feed wheel. The fingers move the strip of stamps from the feed wheel at the radial line of the feed wheel where the top surface of the fingers enter the annular grooves of the feed wheel. The rectangular recess in the enclosure has a set of grooves that are coplanar with the rows of projections of the feed wheel and these grooves extend forwardly of the rectangular opening for a portion of the top and bottom diverging walls as well as along a portion of the rear surface portion of the enclosure above and below for a short distance beyond the rectangular recess to provide the balance of the clearance between the enclosure and the rows of projections of the feed wheel. Above the rectangular recess of the enclosure the rearwardly facing surface is inclined forwardly and upwardly. This inclined surface has grooved extensions for a lower part of its height.

The enclosure has preferably at its forward surface a rectangular rib as a boss in alignment with the opening of the enclosure and the facing walls of the top and bottom portions of the rib. This rectangular rib extends through a rectangular opening in the front panel of the housing for the stamp-dispensing mechanism when it is mounted for use.

The pivotally-mounted arcuate guide has a cylindrical surface facing the feed wheel and its radius of curvature is slightly larger than that of the cylindrical feed wheel as is the radius of curvature of the cylindrical recess of the enclosure. This cylindrical surface of the arcuate guide has a set of grooves that are also coplanar with the rows of projections of the feed wheel. After the leading portion of a strip of a roll of stamps is trained around the arcuate portion of the feed wheel with engagement by rows of projections and extends through the rectangular opening of the enclosure, the arcuate guide is pivoted and then locked in position so that its cylindrical surface is coaxial with the feed wheel. In this position, rows of projections extend into, but spaced from, the grooves in the cylindrical surface of the pivotally-mounted guide. With the guide in this position the stamps are maintained on the feed wheel with the perforations of the strip maintained in engagement with rows of projections until the zone at which the fingers of the enclosure direct the strip away from the feed wheel.

The distal end surface of the pivotally mounted guide is shaped to be essentially parallel with and closely spaced from the inclined surface of the enclosure that extends from the top of the rectangular recess of the enclosure to the top of the marginal portion of the enclosure. This insures the maximum length in which the strip of stamps is maintained by the arcuate guide and the enclosure in engagement with rows of projections during the arcuate travel of the strip provided by the stepping movement of the feed wheel.

Adjacent the distal end portion the pivotaly-mounted guide is constructed with means to lock it in the position at which it retains the strip of stamps in engagement with rows of projections of the feed wheel. This locking means includes a pin extending horizontally through the guide and spring means to bias the pin toward the support plate, that has in its construction a hole in which the pin extends when the pivotally-mounted guide is at the position to be ready for the operation of the stamp-dispensing mechanism. By removing the pin from the hole in the support plate, the guide can be pivoted away from the feed wheel for the purpose of feeding a leading portion of the strip of stamps of the roll, that is mounted on the support plate rearwardly of the feed wheel, around a portion of the feed wheel with engagement by rows of projections and into the cylindrical recess of the enclosure to its rectangular opening.

The construction of the enclosure and the pivotally-mounted guide insure that the strip of stamps are maintained in engagement with rows of projections during its arcuate travel provided by the step movement of the feed wheel but also insures that the strip is not moved from its engagement with the rows of projections during the upward movement of the dispensed portion of the strip when tearing off that dispensed portion from the non-dispensing portion.

The Geneva driver assembly of the invention has been described as a combination of a driver pin and an arm in which the pin is mounted with the wider portion of the tapered arm having a portion of its thickness between parallel planes passing through the longitudinal axis of the driver pin. As an equivalent to the arm, the Geneva driver assembly can be constructed as a disc having a driver pin suitably mounted at one radius and having a boss at another radius with the boss having a cylindrical surface facing toward the periphery of the disc. This peripheral surface of the boss has its center of curvature at the axis of rotation of the disc and is preferably diagonally opposite the location of the driver pin. The radius of curvature of the portion of the boss is approximately that of the radius of curvature of the concave peripheral surface of each tooth of the star wheel and this surface is located on the disc so that it is in the cavity defined by the concave surface of a tooth of the star wheel when the disc is at its home position, i.e., the position before and after the operation of the motor.

DESCRIPTION OF THE DRAWINGS

FIG. 7 is an elevation of the Geneva driver assembly.

FIG. 8 is a side view of the Geneva driver assembly.

FIG. 9 is an elevation of the Geneva star wheel assembly as seen in FIG. 2.

FIG. 10 is a side view of the Geneva star wheel assembly.

FIG. 11 is an elevation of the Geneva star wheel assembly as viewed from the vertical support plate of the stamp-dispensing mechanism.

FIG. 12 is a perspective view of the strip-feeding wheel assembly.

FIG. 13 is a fragmentary perspective view of the strip-feeding wheel assembly and the enclosure in their relationship in the assembled stamp-dispensing mechanism.

FIG. 14 is a fragmentary cross section taken along line 14—14 of FIG. 13.

DETAILED DESCRIPTION

Figure 1:
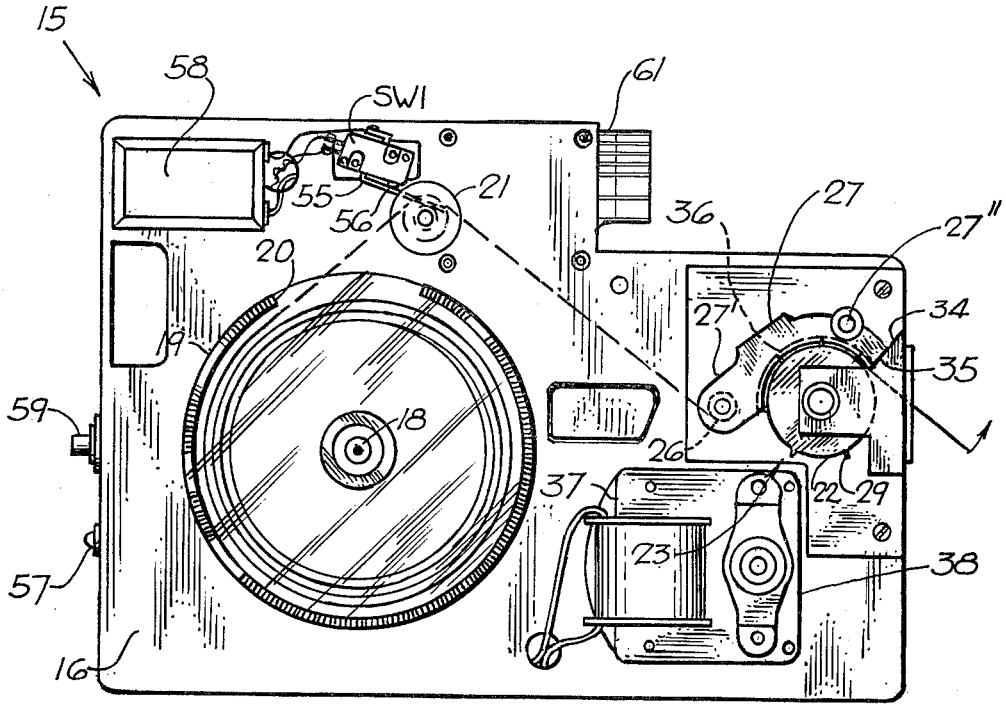
FIG. 1 is an elevation of a preferred embodiment of the stamp-dispensing mechanism.

Referring to FIG. 1, the stamp-dispensing mechanism generally indicated at 15 includes a vertical molded support plate 16 having a flange 17 about most of its periphery, that is located approximately above the longitudinal axis of the base. On the front face support plate 16 there is formed an integral cylindrical hollow boss 18 on which is rotatively mounted a roll of a strip of stamps. From the front face of plate 16 extends a cylindrical wall 19 that is concentric with boss 18. A circular cover plate (not numbered) is mounted on boss 18 parallel to support plate 16 to provide with support plate 16 and cylindrical wall 19 a housing for a roll of a strip of stamps. The cover plate is held in place by a locking bolt that is threaded into an internally threaded hollow cylinder secured in boss 18. The cylindrical wall 19 has an upper opening 20 to permit the passage of the strip of stamps from the housing.

Figure 2:
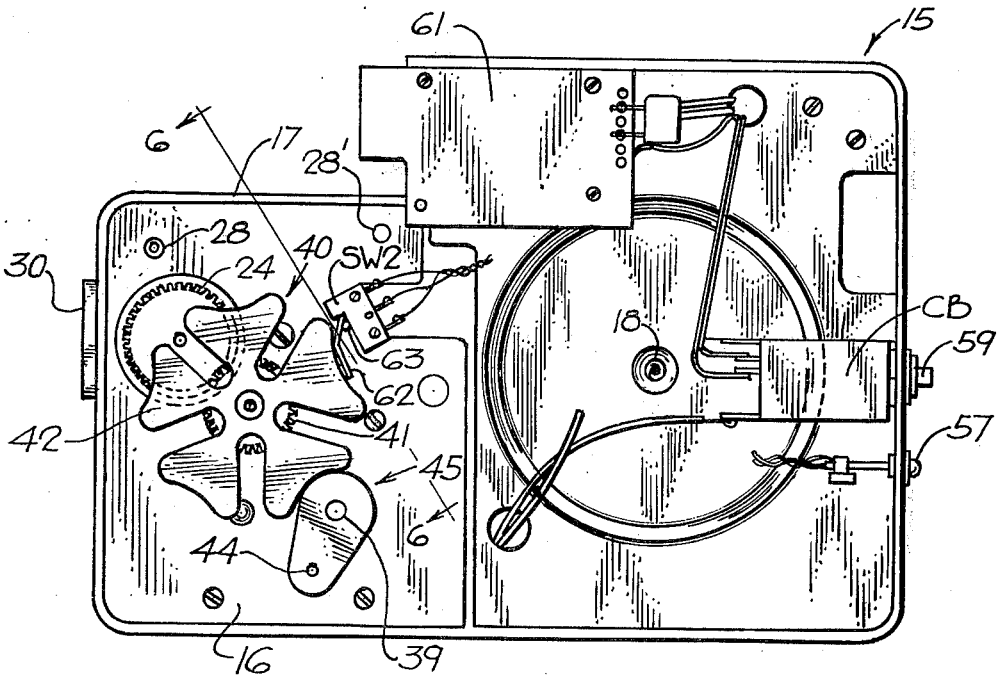
FIG. 2 is the opposite elevation of the stamp-dispensing mechanism showing the gear of the strip-feeding wheel assembly, the Geneva star wheel assembly, the Geneva driver assembly and the printed circuit board, but not showing electrical components that are mounted on the board to provide a part of that control logic for programmed dispensing of stamps.

A small guidance roller 21 is mounted on support plate 16. From the housing the strip of stamps is trained over roller 21 to the upper peripheral surface of a feed wheel 22 of a strip-feeding wheel assembly generally indicated at 23 (FIG. 12) that also includes a gear 24 (FIGS. 2 and 12). The strip-feeding wheel assembly 23 includes in a horizontal shaft 25 on which are fixedly mounted feed wheel 22 and gear 24. The shaft 25 of assembly 23 is rotatably mounted on support plate 16 with feed wheel 22 on one side and with gear 24 on the other side of support plate 16.

Between guidance roller 21 and feed wheel 22 the strip of stamps is trained under a horizontal pivot rod 26 fixedly mounted at one end on support plate 16. An arcuate guide 27 has at one of its ends a pair of spaced arms 27′ that are pivotally mounted on rod 26. A locking pin 27″ extends through arcuate guide 27 adjacent its other end, e.g., its distal end, and into a hole 28 in support plate 16 when locking pin 27″ locks arcuate guide 27 into the position shown in FIG. 1. It is at this location when stamp-dispensing mechanism 15 is ready to operate. The arcuate guide 27 has a transverse recess (not shown) in an intermediate part of its top portion at the location of locking pin 27″ so that pin 27″ extends across this recess. A spring (not shown) is mounted on pin 27″ at the recess. The spring is secured at one end to pin 27″ and at the other end abuts arcuate guide 27 so that locking pin 27″ is biased against support plate 16.

To remove pin 27″ from hole 28 to move arcuate guide 27 away from feed wheel 22, the head of pin 27″ is grasped and pin 27″ is pulled away from support plate 16 to remove pin 27″ from hole 28. With this pin in this position, arcuate guide 27 is pivoted counter clockwise (as viewed in FIG. 1) until pin 27″ is in alignment with a hole 28′ in support plate 16. Then pin 27″ is released and it moves into hole 28′. With arcuate guide 27 moved to this position the strip of stamps, after training it over and around guidance roller 21, is trained below and around rod 26 and over and around feed wheel 22 with perforations of the strip engaging rows of projections 29 to extend from wheel 22 to a horizontal opening 30 of an enclosure generally indicated at 31. The arcuate guide 27, when in the locked position shown in FIG. 1, and enclosure 31 provide the means tc retain the strip of stamps in engagement with rows of projections 29 on feed wheel 22.

The distance between each row of projections 29 and adjacent rows corresponds to the distance between adjacent rows of perforations of the strip of stamps. Each step of turning of feed wheel 22 will pull the strip from the roll mounted on boss 18 a distance equal to the length of one stamp. The feed wheel 22 is turned clockwise as viewed in FIG. 1.

The front portion of enclosure 31 is forward of feed wheel 22. As seen in FIG. 14, the rear portion of enclosure 31 has a central rectangular recess (not numbered) with a cylindrical configuration having its center of curvature coaxial with feed wheel 22 when it and enclosure 31 are mounted on support plate 16. A forward chordal section of wheel 22 is in the recess of enclosure 31. The radius of curvature of the recess is slightly greater than that of feed wheel 22 and this cylindrical surface of the recess is slightly spaced from the cylindrical surface of wheel 22. The cylindrical surface of the recess has a set of cylindrical grooves 31′ that are coplanar with projections 29 of wheel 22. The mounting of wheel 22 and enclosure 31 is such that projections 29 pass through grooves 31′ without contacting enclosure 31 during the stepping movement of wheel 22. Coplanar with a shorter vertical chord of wheel 22 the recess of enclosure 31 has horizontal opening 30 that extends forwardly to the front face of enclosure 30 with forwardly diverging top and bottom walls 32 and 32', respectively. The front face of enclosure 31 has a rectangular rib 32'' that has its top and bottom facing walls providing an extension of the diverging walls 32 and 32'.

A pair of spaced fingers 33 extend upwardly and rearwardly from wall 32' of enclosure 31. These fingers 33 extend into a pair of annular grooves 33' in feed wheel 22 that are shown in FIGS. 12, 13 and 14. The fingers 33 are spaced from the walls and the base of annular grooves 33'. The top surface of the distal portion of each of fingers 33 is below the path of travel of a strip of stamps on wheel 22 as the strip is moved into alignment with opening 30 of enclosure 31 so that this top surface of fingers 33 lifts the strip away from wheel 22 into and at least partially out of opening 30.

The sidewalls of opening 30 are also flared outwardly in a preferred construction, as seen in FIG. 13.

The grooves 31' of enclosure 31 extend a short distance into the rearwardly facing surface portion of enclosure 31 beyond the horizontal recess to provide clearance for projections 29. Above the rectangular recess having opening 30 the rearwardly facing surface of enclosure 31 is inclined upwardly and forwardly to provide an inclined surface 34. The arcuate guide 27 has a distal flat surface 35 that is angularly disposed relative to a radial line of arcuate guide 27, so that this flat surface is generally parallel to and closely spaced from inclined surface 34 of enclosure 31 when arcuate guide 27 is in the locked position shown in FIG. 1. The arcuate surface of arcuate guide 27, that faces the cylindrical surface of feed wheel 22, has a set of grooves 36 that are coplanar with the rows of projections 29 on wheel 22. When guide 27 is in the locked position shown in FIG. 1, this arcuate surface of guide 27 is spaced from but sufficiently close to the cylindrical surface of wheel 22 so that projections 29 are in and pass through arcuate grooves 36 with a clearance between guide 27 and projections 29.

Figure 6:
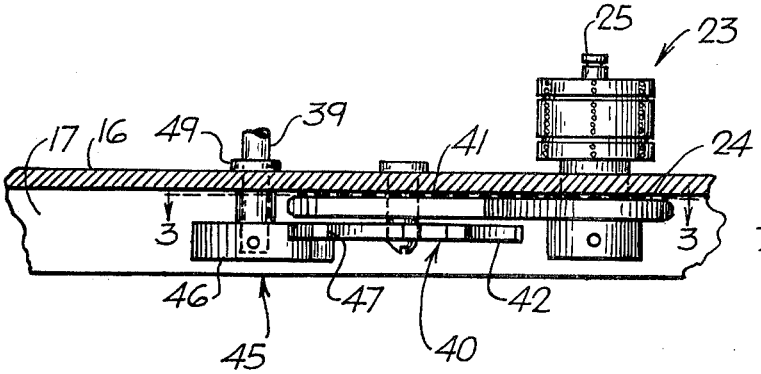
FIG. 6 is a fragmentary view taken along line 6—6 of FIG. 2.

As seen in FIG. 1, fixedly mounted enclosure 31 has, at its side portion remote from support plate 16, a rearwardly extending portion in which is mounted a bearing that provides for the rotatable mounting of one end of shaft 25. Adjacent its other end, shaft 25 is rotatably mounted in a bearing (not numbered) fixedly mounted in an opening in support plate 16 as seen in FIG. 6.

When a portion of the strip of stamps is moved through opening 30 by a cycle of operation of the stamp-dispensing mechanism of the invention, this dispensed portion of the strip of stamps is separated from the dispensed portion of the strip. This is done by lifting the dispensed strip of stamps and tearing it from the undispensed portion at the juncture of the top wall 32 and feed wheel 22. That tear is at a row of perforations because one of the rows of projections 29 is adjacent the inner end of wall 32 at the completion of the dispensing operation. The location of a row of perforations 29 at this point at the end of each step movement of wheel 22 permits this removal of dispensed stamps by tearing at a row of perforations between stamps. The travel of the strip of stamps from the roll of the strip to feed wheel 22 is shown by a dotted line in FIG. 1.

A motor and a gear train speed reducer 38 are mounted on plate 16 on the same side as feed wheel 22. The output shaft 39 (FIGS. 2 and 6) of the gear reducer 35 extends through an opening in support plate 16 to the other side of support plate 16.

The stamp dispensing mechanism is mounted in a cabinet (not shown) having a front panel with rectangular rib 32'' extending through an opening in the front panel of the cabinet.

Referring to FIG. 2, it is seen that gear 24 of strip-feeding wheel assembly 23 is on this side of support plate 16. Rotatively mounted on this side of support plate 16 is a Geneva star wheel assembly generally indicated at 40. In an integral construction the Geneva star wheel assembly 40 includes a gear 41, that meshes with gear 24 of the strip-feeding wheel assembly 23, and a novel star wheel 42, that has a number of equally spaced radial slots 43 extending inwardly from the cylindrical outer peripheral surface of wheel 42. At an intermediate major portion of the peripheral surface of the teeth, i.e., lobes, of wheel 42 between slots 43, the outer peripheral surface is a concave surface 44.

A Geneva driver assembly generally indicated at 45 includes a tapered arm 46 on which is mounted a driver pin 47. The wider portion of tapered arm 46, as seen in FIGS. 7 and 8, has a hole 48 through it. The end of output shaft 39 extends into hole 48. The arm 46 is fixedly mounted on shaft 39 that passes through a bushing 49 (FIG. 6) that extends through and is supported by plate 16.

The wider portion of arm 46 has a greater thickness than a narrower portion of arm 46 to provide a shoulder 50 that has, in the preferred construction, a concave surface from about one edge to about the other edge of arm 46. The peripheral surface of the edge of the wider portion of arm 46 is cylindrical with a radius of curvature that is about that of concave surface 44 of the major intermediate portion of the outer peripheral surface of each tooth of star wheel 42. The driver pin generally indicated at 47 includes a pin (not numbered), that has a shaft and a head, and a hollow stub cylinder rotatably mounted on the shaft. The shaft extends into a hole in arm 46 adjacent the distal end of arm 46 and secured by a set screw (not numbered). Thus driver pin 47 is mounted at the narrower portion of arm 46 to extend from the surface from which shoulder 50 extends. Thus shoulder 50 is between two parallel planes that pass through the stub cylinder of driver pin 47 normal to its longitudinal axis. Also a part of the height of the cylindrical peripheral surface 51 of the wider portion of the tapered arm 46 is between these two parallel planes passing through the longitudinal axis of driver pin 47. The output shaft 39 and driver pin 47 are located relative to each other so that pin 47 during one rotation of Geneva driver assembly 45 by one revolution of shaft 39 moves pin 47 into and back out of one radial slot 43 and during this time Geneva star wheel assembly will be stepped one part of a revolution to provide one step of feed wheel 22.

Figure 5:
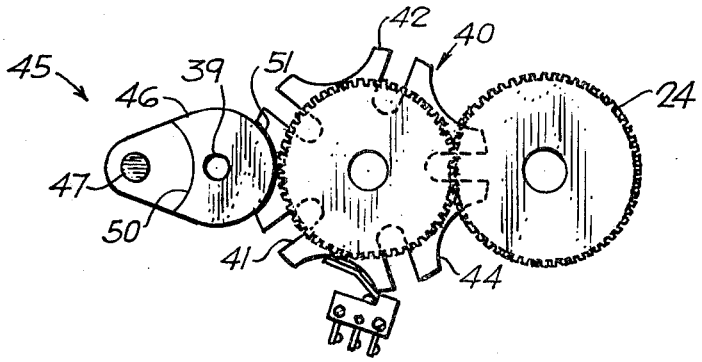
FIG. 5 is a fragmentary view, like FIG. 4, showing the driver arm at a different position during its rotation.

Before the start of the single revolution of arm 46 to move pin 47 through one complete cyclical path, tapered arm 46 is positioned so that part of the thickness of the cylindrical peripheral surface 51 of the wider portion of arm 46 is within the cavity provided by the concave surface 44 of one of the teeth of star wheel 42 but closely spaced from the concave surface as seen in FIG. 5. Thus when the Geneva driver assembly 45 is not operating it is not possible to turn wheel 22 because star wheel 42 cannot be turned.

At the early portion of the turning of Geneva driver assembly 45 by the turning of shaft 39, tapered arm 46 turns to move the cylindrical peripheral surface of its wider portion out of the cavity provided by concave surface 44 of a tooth of star wheel 42. Subsequent further turning of tapered arm 46 moves driver pin 47 into a radial slot 43. The pin 47 moves further and then out of slot 43 for a stepwise turning movement of star wheel 42. During the time that driver pin 47 engages star wheel 42, shoulder 50 faces star wheel 42. Because of its location on arm 46, shoulder 50 is spaced from the teeth of star wheel 42.

As seen in FIG. 1, a switch SW1 is mounted on support plate 16 on the same side of plate 16 that guidance roller 21 is mounted. The guidance roller 21 has flanges at its ends. The strip of stamps is trained over roller 21 between these flanges, that maintain the strip in a correct direction of travel from the roll of strip of stamps to pivot rod 26 and then to feed roll 22. Intermediate its length, guidance roller 21 has an annular groove (not numbered). The switch SW1 has an arm 55 that extends to guidance roller 21. The arm 55 is in the groove of roller 21 when a strip of stamps is not trained over roller 21. When the strip of stamps is trained over roller 21, the strip moves arm 55 to depress a button 56 to operate switch SW1. When the stamp-dispensing mechanism runs out of stamps to the extent that the strip is not on roller 21, button 56 moves arm 55 into the annular groove of guidance roller 21. When 56 is depressed, switch SW1 operates circuitry, that is not shown but fully disclosed in said copending patent application, to turn on an LED 57. The LED 57 is mounted on the rear vertical portion of flange 17 of support plate 16.

On the same side of support plate 16 as switch SW1 is mounted a decimal counter 59 that has unnumbered wires connected to it. These wires are connected to a switch SW2 mounted on the other side of support plate 16.

A circuit breaker CB is also mounted on the rear vertical portion of flange 17 of support plate 16 as seen in FIG. 2. The reset button 59 of circuit breaker CB extends rearwardly of that rear portion of flange 17. Various wires extend from circuit breaker CB and these are also part of the electrical circuitry that is fully described in said copending patent application.

A printed circuit board 61 is mounted on the side of support plate 16 on which Geneva driver assembly 45 is mounted. The board 61 contains a pattern of printed conducting lines. Various electrical components, that are not shown in FIG. 2, are mounted on board 61 and constitute a part of the control logic for the operation of stamp-dispensing mechanism 15. That logic and a main control logic determine the number of stamps dispensed for a cycle of selected operation of mechanism 15. The copending patent application mentioned above describes fully the nature of the control logic of mechanism 15 and the main control logic that provides signals to the control logic of mechanism 15 or signals to one or more mechanisms 15 when more than one stamp-dispensing mechanism is present in a stamp vending machine. That copending patent application is hereby incorporated by reference. It describes the function of the various connecting wires that are shown in FIGS. 1 and 2 as well as other connecting wires and printed conducting lines.

Figure 3:
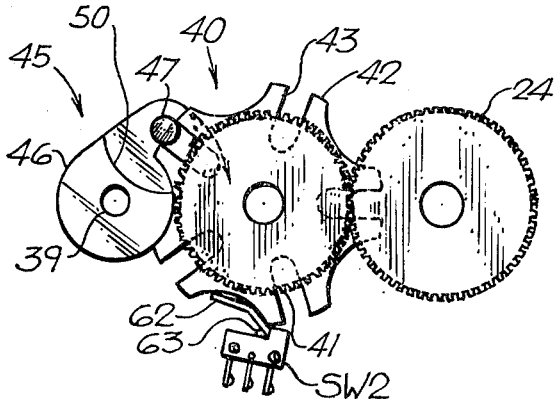
FIG. 3 is a view of the gear of the strip-feeding wheel assembly, the Geneva star wheel assembly, and the Geneva driver assembly along with a switch, taken along line 3—3 of FIG. 6.
Figure 4:
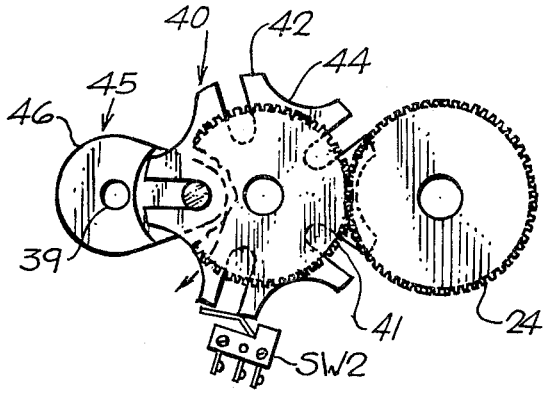
FIG. 4 is a fragmentary partial view of components, seen in FIG. 3, showing the Geneva driver assembly at another position during one revolution of the arm of that assembly.

The switch SW2 has a pivotally mounted arm 62 and a button 63 that is a spring-biased button like button 56 of switch SW1. The arm 62 is maintained by button 63 at the position shown in FIGS. 2, 3 and 5 until it is moved by a tooth of star wheel 42. The moving arm 62 depresses button 63 to operate switch SW2. This depression of button 63 is shown in FIG. 4. The one tooth of moving star wheel 42 has moved arm 62 to depress button 63 and the next tooth of star wheel 42 also engages arm 62. This next tooth maintains it in the position of depressing button 63 until there is sufficient turning of star wheel 42 to bring the concave surface 44 of this next tooth opposite arm 62. Then button 63 moves arm 62 of this next tooth. This operation of arm 62 and the depression and release of button 63 results in the operation of decimal counter 58 for a count of one stamp dispensed by the cycle of operation of the stamp-dispensing mechanism. Also, this operation of switch SW1 provides a count pulse in the control logic of the stamp-dispensing mechanism mounted on board 61. The operation of the control logic is determined by the number of count pulses required in accordance with the programming that it receives from the main control logic. This is fully explained in said copending patent application.

The arm 62 has an intermediate bend away from star wheel 42 and the length of the arm from the bend to the distal end is sufficient to span slot 43 during the stepping movement of star wheel 42. The location of the bend is such that the cylindrical outer peripheral surface of stepping stare wheel 42 contacts arm 62 at the bend and the extent of the bend is such that the portion of arm 62 beyond the bend clears the cylindrical outer peripheral surface of wheel 42. The switch SW2 is located so that when the bend is engaged by concave surface 44 of star wheel 42 arm 62 depresses button 63.

In an earlier design of stamp-dispensing mechanism 15, switch SW2 was a cam switch that was mounted on support plate 16 so that the button of the cam switch was depressed momentarily by the end of the narrower portion of rotating arm 46, after arm 46 had provided a step movement of star wheel 42. This momentary depression of the button stopped the operation of motor 37. Until motor 37 stopped, arm 46 continued its turning. This earlier design resulted in a shorter life of the switch because the annular velocity of arm 46 is much greater than that of the stepping movement of star wheel 42.

The support plate 16 has a top right-hand cut-out portion into which a part of printed circuit board 61 extends. This part of board 61 contains printed conducting lines. Similar lines appear on the other side of board 61 but they are now shown in FIG. 2. These printed conducting lines provide connections between the control logic, that includes board 61 and components mounted on board 61 to a slotted connector to which are connected the wires connected to the main control logic and to a power supply, as described in said copending patent application.

The support plate 16 has a somewhat rectangular opening at the rear margin merely for the purpose of carrying the stamp-dispensing mechanism and to hold it while sliding the stamp-dispensing mechanism in position in the cabinet of the stamp vending machine.

The illustrated support plate 16 with its flanges 17 and wall 19 is an inexpensive molded article having a boss for supporting switch SW1 and strengthening ribs (FIG. 2).

It can be seen by a comparison of FIGS. 2, and 9 through 11 with FIGS. 3–6 that star wheel 42 shown in FIGS. 2 and 9–11 has a larger diameter than star wheel 42 shown in FIGS. 3–11 for the same diameter of gear 41. The larger diameter star wheel 42 was adopted to provide a higher driving torque. When this change was made, driver assembly 45 was correspondingly modified and the axis of rotation of arm 46 was relocated.

As seen in FIG. 12, feed wheel 22 does not have two projections 29 at specific locations for each row of projections. Instead, wheel 22 has annular grooves at these locations to provide clearance between the pair of fingers 33 and wheel 22. This construction is present in wheel 22 when fingers 33 are part of the construction. That is the preferred aspect of the construction.

In the use of the stamp-dispensing mechanism of the invention, it is mounted in a cabinet having a front panel with a coin-receiving slot and a pushbutton or switch. The stamp vending machine further includes a coin control unit that tests coins to be sure that they are genuine and returns coins that are rejected to a coin return receptacle mounted on the cabinet behind a door at an opening at the front panel of the cabinet. A button or switch on the front panel is manually operated to start motor 37 if the coin control unit has operated to identify the correct denomination of the coin inserted or correct number and denominations of a plurality of coins inserted. The coin control unit can be a conventional unit and it is deemed unnecessary to show the electrical circuitry to energize motor 37 until switch SW2 has been operated the programmed number of times by star wheel 42.

It should be apparent from the foregoing description of the stamp-dispensing mechanism of the present invention that it can be used to modify the stamp-dispensing mechanisms described in the three patents mentioned above. This modification results in a more simple construction and provides the advantages mentioned above. The stamp-dispensing mechanism of the present invention, with its automatic locking of feed wheel 22, is also advantageously useful as modules in a stamp vending machine, that is disclosed and claimed in said copending patent application.

The foregoing description has been presented solely for the purpose of illustration and not by way of limitation of the invention because the latter is limited only by the claims that follow.

We claim:

1. A dispensing mechanism for units of equal dimensions as a strip having equally spaced transverse rows of perforations, such as a strip of stamps, which comprises:

support means including a vertical support plate having front and rear portions, said support means being constructed to support on the rear portion of one side of said plate a roll of a strip having equally spaced transverse rows of perforations for rotation of the roll about a horizontal axis;

a Geneva drive system comprising:

a Geneva star wheel assembly that includes:

a star wheel having a central hole for rotatably mounting said wheel by a shaft that is mounted on said support plate, said star wheel having a number of equally spaced radial slots extending inwardly from the peripheral surface of said star wheel to provide a number of teeth, said teeth at their distal ends providing a cylindrical outer peripheral surface of said wheel except for an intermediate portion of the outer surface of each tooth that has a concave surface having the same radius of curvature for all teeth; and a Geneva driver assembly including:

a driver pin; and pin-mounting means that has a hole for mounting on a shaft that is mounted on said support plate, with said pin being mounted on said pin-mounting means to extend with the axis of the pin parallel to and spaced from and at one radius from said hole of said pin-mounting means, said pin-mounting means having a portion that extends in the same direction that said pin extends and that is between two radii from said hole other than the radius at which said pin is mounted, said extension of said portion of said pin-mounting means having a cylindrical peripheral surface:

that is between parallel planes passing through and normal to the longitudinal axis of said pin;

that has its center of curvature at the center of said hole;

that has a radius of curvature that is approximately the radius of curvature of the concave surface portion of each tooth of said star wheel; and that has its ends at a plane that is parallel to the axis of said pin and that passes through the radius from said hole to said pin, said Geneva drive system being mounted on said shafts on said support plate so that said star wheel and said pin-mounting means are rotatable at horizontal axes that are spaced from each other so that said driver pin, during rotation of said pin-mounting means moves into and then out of one radial slot of said star wheel during one revolution of said pin-mounting means to move said star wheel one step of its rotation, after said extension of said portion of said pin-mounting means has its cylindrical surface moves from the cavity of a tooth and before it enters a cavity of another tooth;

motor means mounted on said support plate;

means operatively connecting said motor means to said pin-mounting means at its said hole to rotate said pin-mounting means about a horizontal axis during the operation of said motor means;

a strip-feeding wheel assembly mounted on the front portion of said one side of said support plate for rotation about a horizontal axis, said strip-feeding wheel assembly including a feed wheel having a generally cylindrical peripheral surface with equally spaced rows of projections extending outwardly from said cylindrical surface, each row of projections being parallel to the longitudinal axis of said feed wheel and the distance between adjacent rows of projections being equal to the distance between adjacent rows of the perforations of said strip;

means operatively connecting said strip-feeding wheel assembly to said star wheel to step move said feed wheel when said star wheel is step moved, said feed wheel being in alignment with a roll of the strip mounted on said support means; and guide means mounted on said one side of said support plate adjacent said feed wheel and including:

an enclosure at the end of the front portion of said support plate and having a horizontal opening through which the strip of stamps being moved by said feed wheel is dispensed after leaving said feed wheel;

an arcuate guide pivotally mounted on one side end portion for movement about a horizontal axis that is adjacent said feed wheel and that is at a vertical plane between said feed wheel and said position of mounting of the roll of the strip, said arcuate guide having an arcuate surface with the radius of curvature approximately that of the radius of said feed wheel so that the arcuate surface can be positioned close to a portion of the cylindrical surface of said feed wheel during the operation of the mechanism, to maintain the strip in engagement with said rows of projections on said feed wheel during the dispensing operation, and so that, before starting the use of the mechanism, said arcuate guide can be pivoted away from said feed wheel to train the strip around a portion of said feed wheel after a roll is loaded on said mechanism and then returned to the position in which the arcuate surface is closely spaced from said feed wheel, said arcuate surface of said arcuate guide having arcuate grooves that are coplanar with said rows of projections of said feed wheel so that said rows of projections of said feed wheel can pass through said grooves with clearance during the turning of said feed wheel;

a locking pin mounted on the distal end portion of said arcuate guide; and spring means biasing said pin into a hole in said support plate that locks said arcuate guide in the position at which said arcuate surface is closely spaced from said feed wheel.

2. The dispensing mechanism of claim 1 wherein:

said pin-mounting means is a tapered arm having a narrower portion and a wider portion;

said hole of said arm is located in said wider portion of said arm and said pin is located in said narrower portion adjacent the distal end of said narrower portion of said arm;

said wider portion has a greater thickness, to provide said extension with a shoulder, that is at the junction between said wider and narrower portions and that at least partially faces said pin; and said extension of said wider portion provides by its peripheral surface, that faces away from said pin, said cylindrical peripheral surface being between said parallel planes passing through the longitudinal axis of said pin.

3. The dispensing mechanism of claim 2 wherein said shoulder of said arm has a concave surface that faces said pin and the ends of said shoulder are adjacent the ends of said cylindrical peripheral surface of said extension.

4. The dispensing mechanism of claim 3 wherein:

said means operatively connecting said motor means to said arm of said Geneva driver assembly comprises speed-reducer means that is connected to the rotor shaft of said motor means and that has an output shaft fixedly secured in said hole of said arm to provide rotation of said arm during operation of said motor means;

said means operatively connecting said strip-feeding wheel assembly to said star wheel is provided by:

a first horizontal shaft rotatively mounted on said support plate to provide said rotatable mounting of said star wheel, said star wheel being fixedly mounted on said shaft;

a first gear fixedly mounted on said first shaft;

a second horizontal shaft rotatively mounted on said support plate and having said feed wheel fixedly mounted on it; and a second gear fixedly mounted on said second shaft and engaging said first gear.

5. The dispensing mechanism of claim 4 in which said enclosure has a horizontal cylindrical recess facing rearwardly and in which a forward chordal section of said feed wheel extends, said recess having at its base portion said horizontal opening and the top and bottom walls of said recess having arcuate grooves that are coplanar with said rows of projections of said feed wheel to continue the maintenance of said strip in engagement with said projections provided initially by said arcuate guide.

6. The dispensing mechanism of claim 5 in which:

said feed wheel has a pair of annular grooves;

said enclosure includes a pair of spaced fingers extending upwardly and rearwardly in said opening of said enclosure and into said annular grooves but spaced from said feed wheel to direct the strip away from said feed wheel and through said horizontal opening of said enclosure;

said enclosure has a flat surface extending upwardly and forwardly from said horizontal cylindrical recess; and said arcuate guide has at its distal end a flat surface angularly disposed to be generally parallel and adjacent said inclined flat surface of said enclosure when said arcuate guide is locked in position around an arcuate portion of said feed wheel.

7. The stamp dispensing mechanism of claim 6 and further including switch means mounted on said support plate at a position to be operated by said Geneva drive system during each cycle of its operation to provide a signal indicating a dispensing of one unit of said units of equal dimensions of said strip.

8. The dispensing mechanism of claim 7 wherein said switch means includes an arm pivotally mounted and a button biased to move said arm to a first position, said arm when moved from said first position to a second position depresses said button to operate said switch means to provide said count signal, said switch means being located so that said arm is moved from said first position to said second position by said star wheel during its step movement, said arm being bent at an intermediate part of its length to be located within a cavity of a tooth of said star wheel before a step movement of said star wheel and having a distal end portion from said bend of sufficient length to span a radial slot during the step movement of the star wheel while the bent arm is at the second position where it is moved by the star wheel during its step movement.

9. The dispensing mechanism of claim 8 wherein:

said motor means and said speed-reducer means are mounted on said one side of said support plate;

said output shaft of said speed-reducer means extends through said support plate;

said Geneva drive system is mounted on the other side of said support plate;

said second shaft on which said feed wheel is fixedly mounted extends through said support plate to said other side;

said first and second gears are on said other side; and said switch means is on said other side.

10. The dispensing mechanism of claim 9 and further including:

a guidance roller mounted on said one side of said support plate for rotation about a horizontal axis and located to train a strip over the guidance roller and then to the feed wheel to direct the strip from the roll to said feed wheel, said guidance roller having an intermediate annular groove;

second switch means mounted on said one side of said support plate and having an arm and a button that biases that arm to a first position, said second switch means being located on said support plate so that its said arm is in said annular groove of said guidance roller when a strip is not trained over the roller and said arm is moved to a second position, when a strip is trained over said guidance roller, to depress said button of said second switch means, said switch means providing a voltage signal when said button of said second switch means is not depressed to indicate the strip is not trained over said guidance roller.

11. The dispensing mechanism of claim 1 in which said enclosure has a horizontal cylindrical recess facing rearwardly and in which a forward chordal section of said feed wheel extends, said recess having at its base portion of said horizontal opening and the top and bottom walls of said recess having arcuate grooves that are coplanar with said rows of projection of said feed wheel to continue the maintenance of said strip in engagement with said projections provided initially by said arcuate guide.

12. The dispensing mechanism of claim 11 in which:

said feed wheel has a pair of annular grooves;

said enclosure includes a pair of spaced fingers extending upwardly in said opening of said enclosure and into said annular grooves but spaced from said feed wheel to direct the strip away from said feed wheel and through said horizontal opening of said enclosure;

said enclosure has a flat surface extending upwardly and forwardly from said horizontal cylindrical recess; and said arcuate guide has at its distal end a flat surface angularly disposed to be generally parallel and adjacent said inclined flat surface of said enclosure when said arcuate guide is locked in position around an arcuate portion of said feed wheel.

13. The stamp dispensing mechanism of claim 12 and further including switch means mounted on said support plate at a position to be operated by said Geneva drive system during each cycle of its operation to provide a signal indicating a dispensing of one unit of said units of equal dimensions of said strip.

14. The dispensing mechanism of claim 13 wherein said switch means includes an arm pivotally mounted and a button biased to move said arm to a first position, said arm when moved from said first position to a second position depresses said button to operate said switch means to provide said count signal, said switch means being located so that said arm is moved from said first position to said second position by said star wheel during its step movement, said arm being bent at an intermediate part of its length to be located within a cavity of a tooth of said star wheel before a step movement of said star wheel and having a distal end portion from said bend of sufficient length to span a radial slot during the step movement of the star wheel while the bent arm is at the second position where it is moved by the star wheel during its step movement.

* * * * *

UNITED STATES PATENT AND TRADEMARK OFFICE

CERTIFICATE OF CORRECTION

PATENT NO. : 4,033,494

DATED : July 5, 1977

INVENTOR(S) : Charles G. Middleton et al.

It is certified that error appears in the above-identified patent and that said Letters Patent are hereby corrected as shown below:

Column 1, line 53, "that was" should read --than were--.
Column 3, line 1, "by" should read --about--.
Line 19, "assembly that" should read --assembly--.
Line 64, "it an" should read --in an--.
Column 6, line 25, "pivotaly-mounted" should read --pivotally-mounted--.
Column 9, line 52, "the dispensed portion" should read --the undispensed portion--.
Column 11, line 25, "56" should read --button 56--.
Line 32, "counter 59" should read --counter 58--.
Column 12, line 8, "of this next tooth" should read --outwardly into the cavity provided by the concave surface of this next tooth--.
Line 25, "stare" should read --star--.
Line 40, "annular" should read --angular--.
Line 48, "now" should read --not--.
Line 66, "3-11" should read --3-6--.
Column 14, line 36, "moves" should read --moved--.
Line 67, "one side end" should read --one end--.
Column 17, line 33, "upwardly" should read --upwardly and rearwardly--.

Signed and Sealed this

*Twenty-fifth* Day of *October 1977*

[SEAL]

*Attest:*

RUTH C. MASON
*Attesting Officer*

LUTRELLE F. PARKER
*Acting Commissioner of Patents and Trademarks*